US005649820A

United States Patent [19]

Keller et al.

[11] Patent Number: 5,649,820

[45] Date of Patent: Jul. 22, 1997

[54] FLARE BURNER

[75] Inventors: Michael R. Keller, Tulsa; John R. Petersen, Pawnee; Robert C. Phillips; David S. Caffey, both of Tulsa; Jeffrey T. Parker, Bixby, all of Okla.

[73] Assignee: Callidus Technologies, Tulsa, Okla.

[21] Appl. No.: 435,249

[22] Filed: May 5, 1995

[51] Int. Cl.[6] ..... F23D 23/00

[52] U.S. Cl. ..... 431/202; 431/352; 239/565

[58] Field of Search ..... 431/352, 202, 431/5, 350, 175, 285, 12; 239/565, 568, 521

[56] References Cited

U.S. PATENT DOCUMENTS

| | | | |
|---|---|---|---|
| 3,749,546 | 7/1973 | Reed et al. | 431/202 |
| 3,791,697 | 2/1974 | Hokao et al. . | |
| 3,801,261 | 4/1974 | Reed et al. . | |
| 4,052,142 | 10/1977 | Reed et al. | 431/202 |
| 4,070,146 | 1/1978 | Straitz, III | 431/202 |
| 4,188,183 | 2/1980 | Zink et al. | 431/202 |
| 4,323,343 | 4/1982 | Reed et al. | 431/202 |
| 4,343,605 | 8/1982 | Browning . | |
| 4,565,522 | 1/1986 | Schwartz . | |
| 4,573,906 | 3/1986 | Schwartz et al. . | |
| 4,579,521 | 4/1986 | Schwartz et al. . | |
| 4,604,048 | 8/1986 | Schwartz et al. . | |
| 4,664,617 | 5/1987 | Schwartz et al. . | |
| 4,900,244 | 2/1990 | Keller et al. . | |
| 5,079,403 | 1/1992 | Sturges et al. . | |
| 5,180,302 | 1/1993 | Schwartz et al. . | |
| 5,195,884 | 3/1993 | Schwartz et al. . | |
| 5,224,851 | 7/1993 | Johnson . | |
| 5,257,500 | 11/1993 | Venkataramani et al. . | |

*Primary Examiner*—James C. Yeung
*Attorney, Agent, or Firm*—Pennie & Edmonds, LLP

[57] ABSTRACT

A flare burner comprises a stack conduit, a plurality of gas distributing conduit extending radially from the stack conduit, and a plurality of gas supersonic gas nozzles connected to the gas distributing conduit. The stack conduit supplies flare gas to each of the gas distributing conduits, with gas communication therebetween. In one embodiment, the nozzles are directly connected to gas distributing conduit and in another embodiment the nozzles are connected to the gas distributing conduits via vertically extending burner conduits. The gas discharged through the supersonic nozzle flows at a supersonic velocity. The length of the burner conduits attached to the same gas distributing conduit becomes progressively shorter as the burner conduits are positioned further away from the stack conduit. In the embodiment where the nozzles are directed connected to the gas distributing conduits, the gas distributing conduits are angled and both ends of the gas distributing conduits are connected to the stack conduit to permit gas to flow from both ends.

22 Claims, 4 Drawing Sheets

FLARE BURNER

BACKGROUND

Different types of flare burners have been contemplated in the past for purposes of disposing waste or vent gases by safely burning them before they escape into the environment. Typically, such flare burners include continuously burning pilot flames for igniting the gases. As discussed in U.S. Pat. No. 4,579,521 issued to Schwartz et al., a single flare gas burner of relatively large diameter has often been used in applications that require a high volume disposal of flare gas. However, such flares seldom operate at its maximum flow condition due to, for instance, varying flare gas flow rates. When the flow rate becomes low, any wind acting on the flare gas burner can cause internal and external burning which can damage the burner. Specifically, internal burning can occur when the gas flow rate through the burner decreases to a degree such that wind blowing transversely across the direction of the vertically standing burner develops a low pressure zone within the open discharge end of the burner which in turn causes air to be drawn into the burner. External burning occurs when the gas flow rate through the burner decreases to a degree such that wind forcibly directs the flame from the burner against the outer wall portion thereof. Accordingly, there is a need for a flare burner that can operate without the problems noted above.

SUMMARY

The present invention relates to a burner, a hydrocarbon flare burner to be more specific, which can overcome the above-noted problems. The flare burner according to the present invention comprises a stack conduit, at least one gas distributing conduit connected to the stack conduit and a plurality of gas supersonic gas nozzles connected to the gas distributing conduit. The stack conduit, which communicates with the gas distributing conduit(s), supplies flare gas to the supersonic nozzles.

In one embodiment, a plurality of spaced apart burner conduits extend upwardly from the gas distributing conduit. The supersonic nozzles, which produce a supersonic flow, are connected to all or some of the free ends of the burner conduits. The burner conduits are spaced apart from each other along the length of the same gas distributing conduit. The gas discharged through the supersonic nozzle thus exits at a supersonic velocity. Preferably, a supersonic nozzle is connected to each of the burner conduits.

Preferably, a plurality of gas distributing conduits are connected to the stack conduit, each carrying a plurality of upwardly extending burner conduits, with each burner conduit carrying a supersonic nozzle. The length of the burner conduits attached to the same gas distributing conduit are preferably different. Specifically, the length of the burner conduits connected to the same gas distributing conduit becomes progressively shorter as the burner conduits move further away from the stack conduit. In the preferred embodiment, the length of the burner conduits is such that an imaginary line connecting the first ends of the burner conduits within the same distributing conduit forms an angle of about 60° with the distributing conduit. Preferably, eight equally spaced gas distributing conduits extend radially and substantially perpendicularly to the stack conduit.

The burner conduits connected to the same gas distributing conduit are aligned and spaced radially therealong, preferably evenly spaced. The burner conduits can be substantially parallel to each other and the stack conduit.

In another embodiment, both ends of each gas distributing conduit are connected to the stack conduit to permit gas to enter from both ends. Preferably, the gas distributing conduit is angled or bent or curved and extends radially outwardly from the stack conduit. In particular, the gas distributing conduit forms an upper conduit arm and a lower conduit arm, where the upper arm preferably slopes downwardly as it radially extends outwardly and where the lower angled arm slopes upwardly as it radially extends outwardly. The upper arm can also extend perpendicularly to the stack conduit. The supersonic nozzles are connected preferably directly to the upper conduit arm. The burner conduits can also be used to connect the nozzles to the upper conduit arm if desired. Preferably, a plurality of angled gas distributing conduits are connected to the stack conduit, spaced evenly around the stack conduit, eight gas distributing conduits being preferred.

BRIEF DESCRIPTION OF THE DRAWINGS

These and other features, aspects, and advantages of the present invention will become much more apparent from the following description, appended claims, and accompanying drawings where:

DESCRIPTION OF THE DRAWINGS

Figure 1:
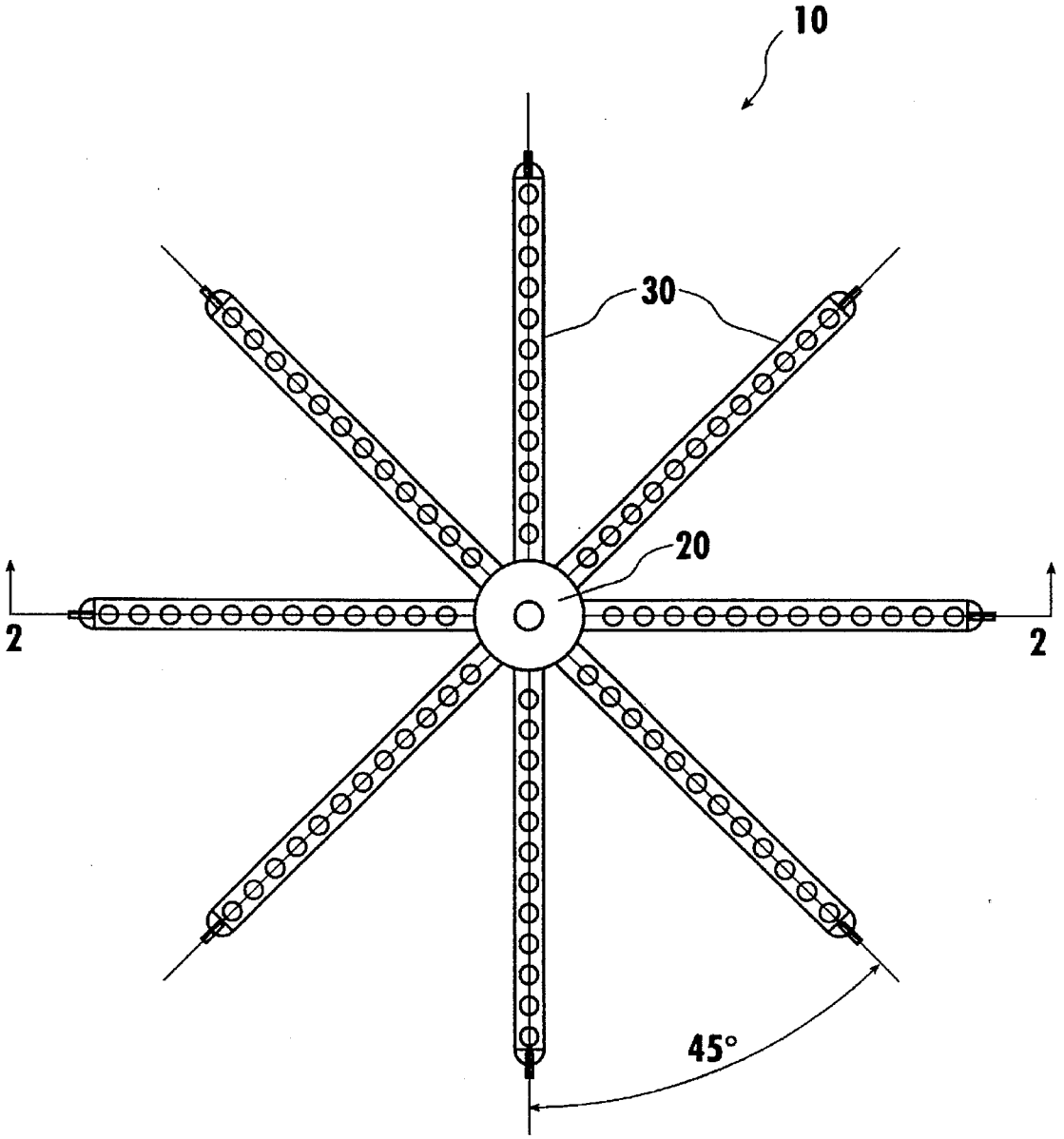
FIG. 1 is a schematic top elevational view of a flare burner according to one embodiment of the present invention.

FIG. 1 shows an embodiment of a flare burner 10 according to the present invention, which comprises a vertically oriented gas stack conduit 20 and a plurality of gas distributing conduits 30 connected to the stack conduit and extending radially outwardly substantially perpendicularly to the stack conduit 20. However, the gas distributing conduits need not be perpendicular to the stack conduit. For instance, the gas distributing conduits can be angled upwardly or even downwardly according to the present invention. A plurality of upright or vertically oriented burner conduits 40 are connected to and spaced along the length of each gas distributing conduit 30. A supersonic nozzle 50 is connected to each free end of the burner conduits. The flare burner can be connected to a gas line or source using any conventional means such as flanges 22 fastened by bolts and nuts.

As shown in FIG. 1, in the preferred embodiment, eight gas distributing conduits 30 are connected to the stack conduit, with gas communication therebetween. All of the distributing conduits extend radially outward from the stack conduit and perpendicularly to the stack conduit, and spaced evenly therearound. Since eight distributing conduits extend radially around the stack conduit, they are spaced at a 45° interval about the stack conduit 20. Each of the distributing conduits carries a plurality of preferably equally spaced burner conduits that are substantially parallel to each other and parallel to the stack conduit. Each of the burner conduits has a first end and a second end, the first end communicating with the second end so as to permit gas flow. The second ends of the burner conduits are connected to the distributing conduits, with gas communication therebetween. It should be noted that the burner conduits need not extend perpendicularly to the gas distributing conduits; they can generally extend upwardly.

Figure 2:
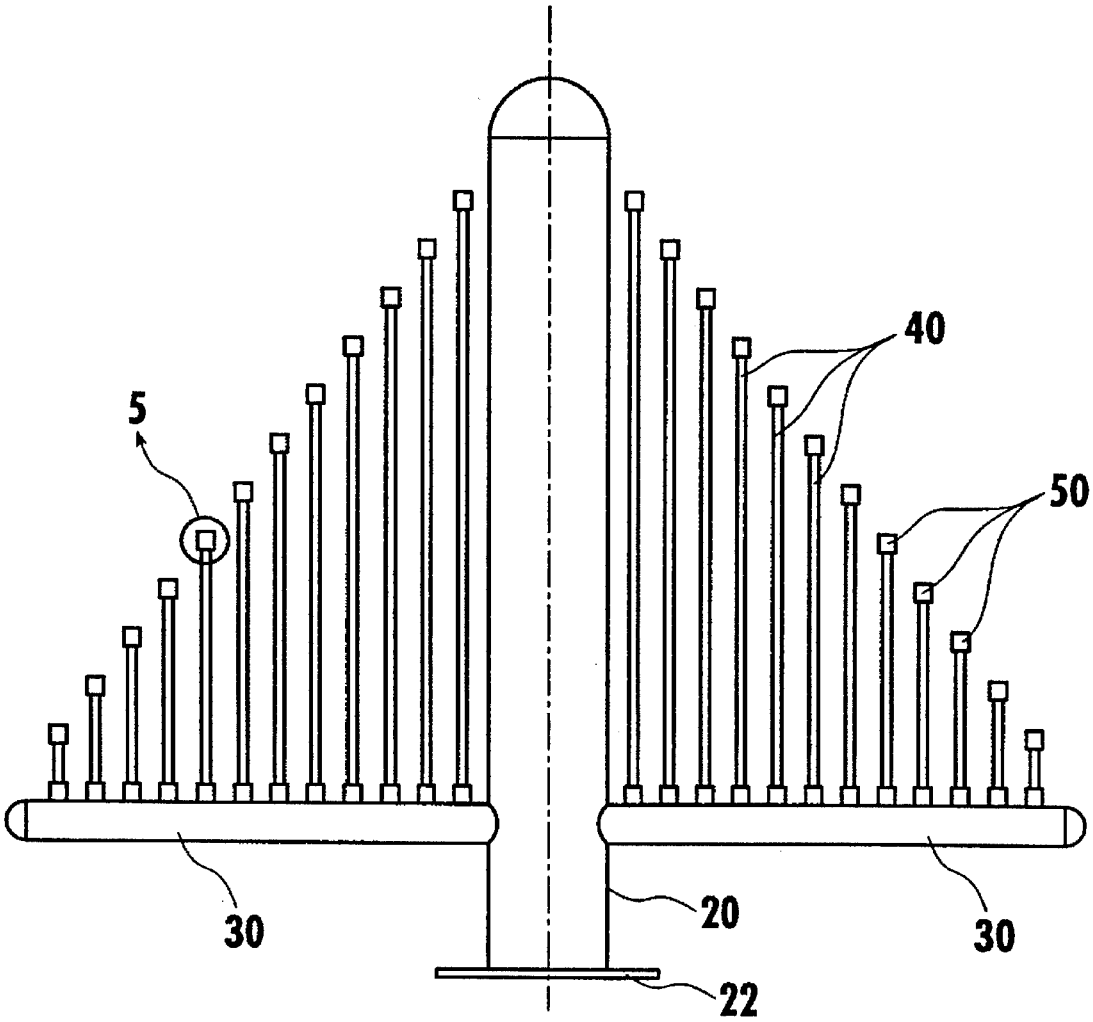
FIG. 2 is a schematic side view of FIG. 1 taken along line 2—2 of FIG. 1.

Moreover, as shown in FIG. 2, the length of the burner conduits becomes progressively shorter as they are positioned further radially away from the stack conduit to maintain the best flow possible through the nozzles. The overall gas travel length, the length of the burner conduit 40 plus the length or distance of that burner conduit from the stack conduit, to the nozzles can be substantially the same. However, it is preferable for the gas travel length to become progressively smaller as the burner conduit is situated further away from the stack conduit to compensate for frictional loss (pressure drop).

In addition, it is desirable to keep the nozzles at different levels to better stabilize the combustion and inspirate air. Specifically, a low pressure zone is formed above the centrally located stack conduit where the high velocity gas exiting the nozzles at the supersonic level slows down to the subsonic level. The low pressure zone is where the combustion takes place. Changing the height of the nozzles relative to the low pressure combustion zone allows the gas to slow down before it reaches the combustion zone. The slower velocity increases the combustion stability.

The gas inspirates air from the time it exits the nozzle to the time it begins combusting. Accordingly, increasing the distance from the exit of the nozzle to the point of combustion increases the duration in which the gas can inspirate air.

According to the embodiment shown in FIG. 2, an imaginary line connecting the first end of the burner conduits within the same distributing conduit forms an angle of about 60° therewith. However, the length of the burner conduits and their spacing can be varied as desired to form any incline angle with respect to the distributing conduit. Moreover, the first end can even be angled relative to the second end, or the upwardly nozzle can be angled relative to the burner conduits. Many different configurations of the burner conduits, the nozzles and the gas distributing conduits are possible within the scope and spirit of the present invention, well within the ambit of one skilled in the art based on the present disclosure.

Figure 3:
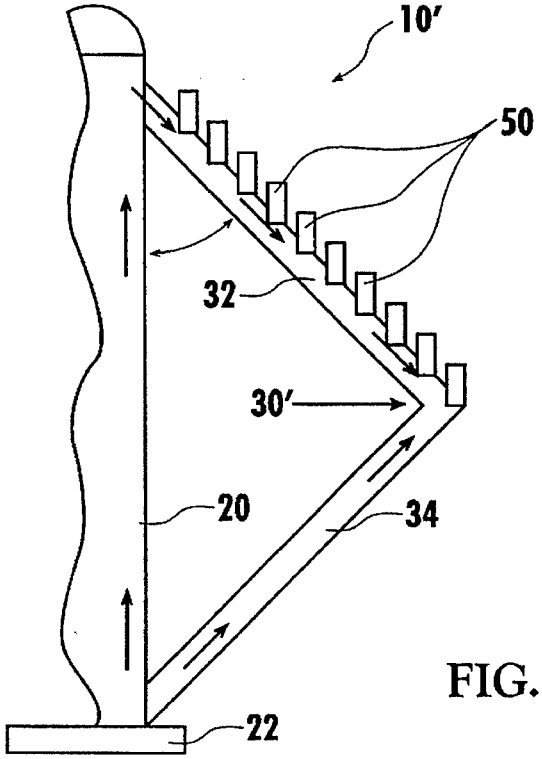
FIG. 3 is a schematic side view of a flare burner according to another embodiment of the present invention.

FIG. 3 shows another embodiment of a flare burner 10' according to the present invention, which comprises a vertically oriented gas stack conduit 20 and a plurality of gas distributing conduits 30' connected to the stack conduit and extending radially outwardly from the stack conduit 20. Although only one of the conduits 30' is shown, it should be noted that this embodiment preferably has up to eight conduits 30' spaced equally around the stack conduit. In this embodiment, both ends of each gas distributing conduit are connected to the stack conduit to permit gas to enter from both ends, as shown by the arrows. As shown in FIG. 3, the gas distributing conduits are angled (but can also be bent or curved) and extend radially outwardly from the stack conduit. In particular, each gas distributing conduit forms an upper conduit arm 32 and a lower conduit arm 34, where the upper arm slopes downwardly as it radially extends outwardly and where the lower angled arm slopes upwardly as it radially extends outwardly. The supersonic nozzles are preferably connected directly to the upper downwardly sloping conduit arm. The downwardly sloping upper arm maintains the supersonic nozzles at different levels. The burner conduits can also be used if desired to extend the nozzles further above the upper conduit arm.

Again, if eight distributing conduits are used, they are spaced at a 45° interval about the stack conduit 20. Each of the distributing conduits preferably carries a plurality of uniformly spaced, upwardly directed supersonic nozzles.

Figure 4:
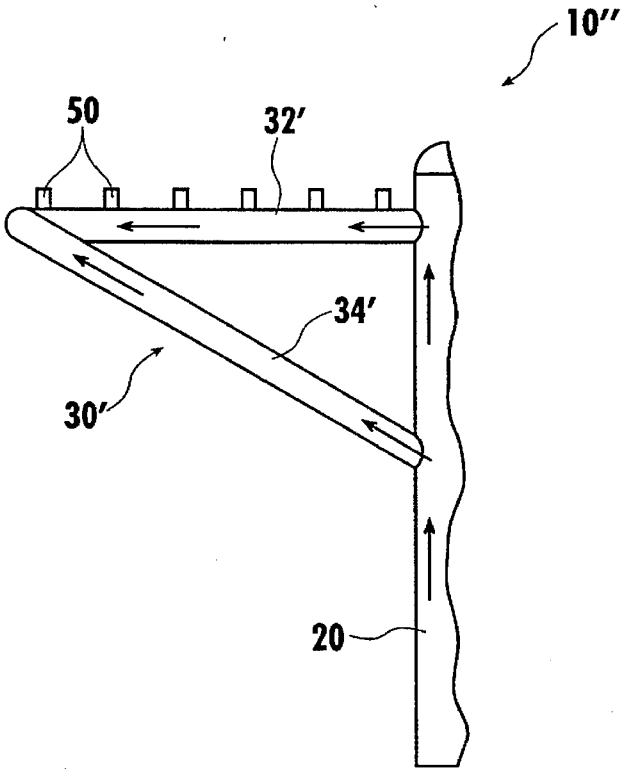
FIG. 4 is a schematic side view of a flare burner similar to FIG. 3

As shown in FIG. 3, the downwardly sloping upper arm is sloped, preferably no less than 45° and no greater than 90° (see FIG. 4) with respect to the stack conduit. FIG. 4 show a flare burner 10" with the upper conduit arm 32' extending substantially perpendicularly (90°) to the stack conduit. The lower conduit arms 34' are still upwardly sloping. The nozzles in this embodiment are thus maintained substantially at the same (horizontal) level. It should be noted that the ends of the bent distributing conduits 30' can lie at a same vertical plane or can be laterally offset, depending on how the conduit 30' is angled or bent.

In these dual feed embodiments, by bringing the waste gas to the gas distributing conduits through both ends thereof, the diameter of the distributing conduits can be less than they would be with one inlet. This reduction of the cross-sectional area of the gas distributing conduit allows for the maximum air flow through the gas distribution conduits and thus to the supersonic nozzles. In addition, the dual inlet permits more equal flow rate of gas to all of the supersonic nozzles than if the gas is fed from a single inlet. Equal gas flow through all of the nozzles provides better air flow. That is, a single inlet causes the flow rate through the nozzle closest to the inlet to be higher than the nozzle furthest from the inlet. As previously described above with respect to the embodiment of FIG. 1, the nozzles positioned at different levels better stabilize the combustion and better inspirate air.

The transfer of energy from a high velocity "primary fluid" to a low velocity "secondary fluid" is a technology which has been developed and used in many applications. Hydrocarbon flare burners have utilized this technology by discharging medium to high pressure hydrocarbon gases through orificed or ported burners. Part of the momentum energy of the high velocity hydrocarbon gas is imparted to the surrounding air resulting in inspiration of the air and turbulent mixing of the inspirated air (secondary fluid) and the hydrocarbon gas (primary fluid). The momentum energy (inspirating power) of the primary fluid is a function of its weight flow rate and exit velocity. However, in all previous ported or orificed burners, the primary fluid's exit velocity has been limited to the sonic velocity (C) of the primary fluid.

The sonic velocity for any gas can be defined as $$C=\sqrt{KgRT}$$

where

K=specific heat ratio (CP/CV)

g=32.2 ft/sec$^2$

R=gas constant—ft—1b/1b°F.

T=Absolute temperature—°R

Once the sonic velocity of the primary fluid was reached (usually at a pressure of 10–15 psig for most hydrocarbon gases) the only way to increase the inspirating power of the burner was to increase the weight flow rate by increasing the primary fluid pressure or increasing the orifice area. Since the pressure available in the primary fluid is always limited by other system factors, the remaining option in previous designs was to increase the orifice area. This option has, in most cases, also proved to be unsatisfactory because the ratio of secondary flow to primary flow is dramatically reduced by increasing the area of the port or orifice.

Figure 5:
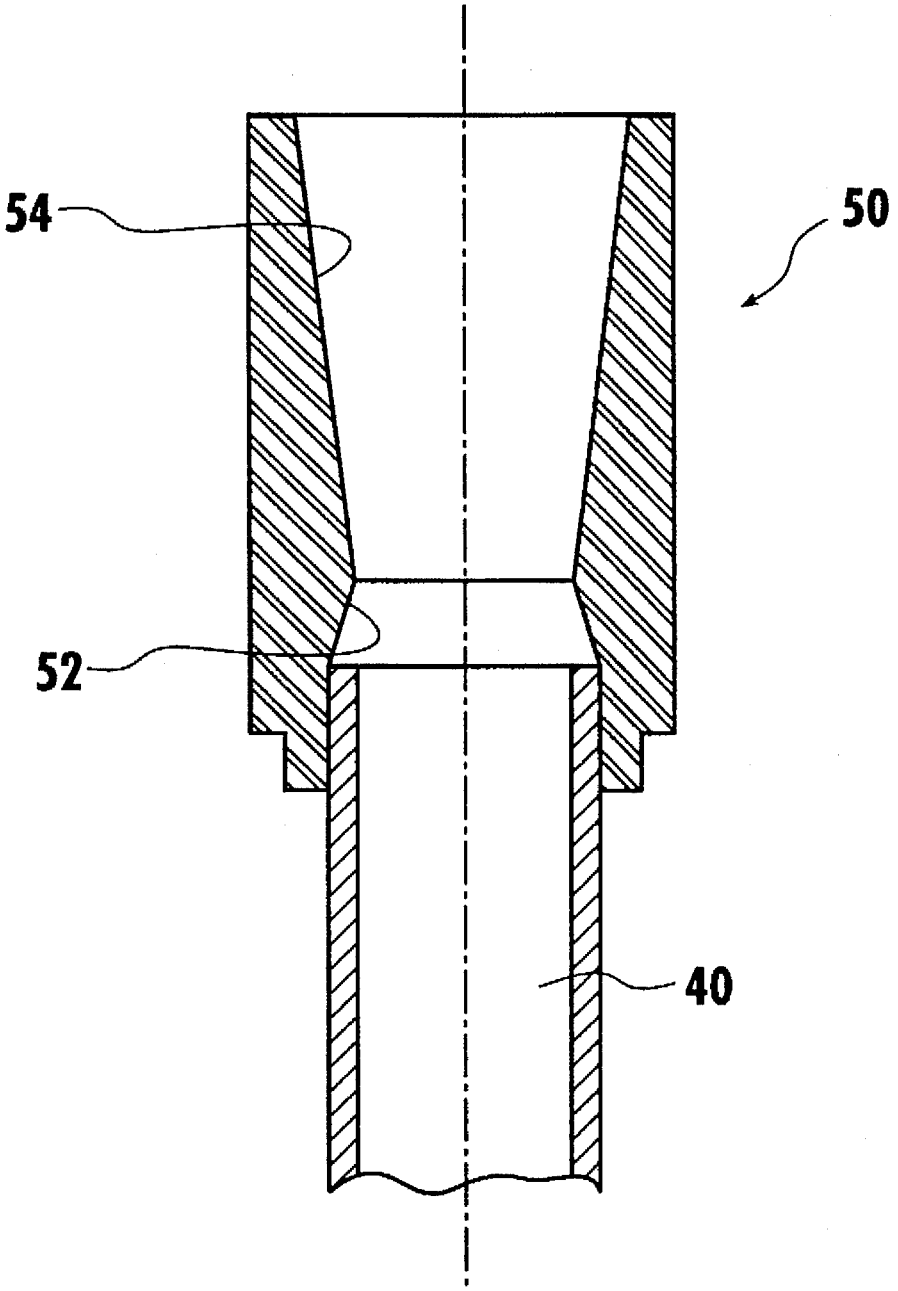
FIG. 5 is an enlarged cross-sectional view of a supersonic nozzle used in the flare burner according to the present invention.

To overcome the above shortcomings, the flare burner according to the present invention operates at velocities well above the previous sonic limitation by utilizing supersonic nozzles. FIG. 5 shows one example of a cross-section of a supersonic nozzle 50 that can be used in the burner to accelerate the flare gas to a supersonic velocity. A supersonic nozzle typically has a convergent section 52 followed by a divergent section 54. Different operations can have different flare gas flow pressures. In this regard, the supersonic nozzle can be dimensioned and made to accommodate different flare gas pressures. The principle behind a supersonic nozzle is common knowledge. It should be noted, however, that any nozzle that will cause the flare gas to exit at a supersonic velocity can be used with the burner according to the present invention. It should also be noted that any pressure greater than ambient atmospheric pressure will cause the flare gas to expel through the supersonic nozzle. However, to obtain a maximum benefit, the flare gas needs to exit the nozzle at a supersonic velocity. This requires a pressure greater than about 30 psig at the upstream end of the nozzle to generate a supersonic exit velocity.

A pilot light (not shown) can be placed anywhere along or near the nozzles. For example, a pilot light can be position at the top of the stack conduit, with a separate gas line for the pilot light running through the stack conduit.

By using supersonic nozzles instead of the conventional straight-drilled ports or orifices, the present supersonic flare burner can inspirate and mix more free air into the combustion zone than flare burners using a conventional subsonic or sonic flare gas flow. This is accomplished by accelerating the discharge gas to velocities to about two to three times the sonic velocity of the conventional sonic burners, along with a corresponding increase in inspirating power. The increased air availability and mixing in the flame zone resultant to the supersonic discharge velocity of the flare gas produce a more rapid combustion resulting in the benefits of 1) smokeless burning; 2) significantly shorter flame length; 3) a significant reduction in the percentage of the heat release which is emitted as radiation; and 4) significantly higher vertical momentum levels above the burner resulting in more vertical, less wind-affected flame configuration.

The drawings illustrated herein represent only two embodiments according to the present invention. Given the disclosure of the present invention, one versed in the art would readily appreciate the fact that there can be many other embodiments and modifications that are well within the scope and spirit of the disclosure set forth herein, but not specifically depicted and described. For example, although the embodiments are described with eight gas distributing conduits, any feasible number can be used according to the present invention. Moreover, the arrangement of the distributing conduits can be made in any desired pattern, including parallely arranged distributing conduits. All expedient modifications readily attainable by one versed in the art from the disclosure set forth herein, within the scope and spirit of the present invention, are to be included as further embodiments of the present invention. Accordingly, the scope of the present invention is to be defined as set forth in the appended claims.

What is claimed is:

1. A flare burner comprising:

a stack conduit for supplying gas;

at least one gas distributing conduit having a first end and a second end, wherein both ends are connected to said stack conduit to permit gas flow into said distributing conduit from both ends; and a plurality of spaced apart, substantially upwardly oriented supersonic nozzles capable of producing a supersonic flow at a predetermined pressure and above situated at said gas distributing conduit, wherein gas discharged through said supersonic nozzle flows at supersonic velocity, and wherein said gas distributing conduit is angled and extends radially from said stack conduit, said gas distributing conduit forming an upper angled conduit arm and a lower angled conduit arm.

2. A flare burner according to claim 1, wherein said upper angled arm slopes downwardly as it radially extends outwardly and wherein said lower angled arm slopes upwardly as it radially extends outwardly.

3. A flare burner according to claim 2, wherein said nozzles are positioned within said upper angled arm.

4. A flare burner according to claim 3, wherein a plurality of angled gas distributing conduits are connected to said stack conduit, each of said angled gas distributing conduits being connected to said stack conduit at both ends to permit gas to flow through said both ends.

5. A flare burner according to claim 4, wherein said angled gas distributing conduits are spaced equally around said stack conduit.

6. A flare burner according to claim 4, wherein up to eight of said angled gas distributing conduits are connected to said stack conduit and spaced equally therearound.

7. A flare burner according to claim 1, wherein said upper angled arm extends radially outwardly perpendicularly to said stack conduit and wherein said lower angled arm slopes upwardly as it radially extends outwardly.

8. A flare burner according to claim 7, wherein said nozzles are positioned within said upper angled arm.

9. A flare burner according to claim 8, wherein a plurality of angled gas distributing conduits are connected to said stack conduit, each of said angled gas distributing conduits being connected to said stack conduit at both ends to permit gas to flow through said both ends.

10. A flare burner according to claim 9, wherein said angled gas distributing conduits are spaced equally around said stack conduit.

11. A flare burner according to claim 9, wherein up to eight of said angled gas distributing conduits are connected to said stack conduit and spaced equally therearound.

12. A flare burner comprising:

a stack conduit for supplying gas;

at least one gas distributing conduit connected to said stack conduit;

a plurality of spaced apart burner conduits, each connected at one end to said at least one gas distributing conduit, lengths of said burner conduits becoming progressively smaller, the further they are positioned from said stack conduit; and a supersonic nozzle attached to a second end of at least a plurality of said burner conduits, each of said supersonic nozzles comprising a converging section followed by a diverging section.

13. A flare burner according to claim 12, wherein a gas travel length from said stack conduit to each of said nozzles is substantially the same.

14. A flare burner according to claim 12, wherein a gas travel length from said stack conduit to each of said nozzles becomes progressively smaller, the further each nozzle's corresponding burner conduit is, from said stack conduit.

15. A flare burner according to claim 12, wherein said burner conduits are substantially parallel to each other.

16. A flare burner according to claim 12, wherein said gas distributing conduit extends radially from, and substantially perpendicular to, said stack conduit.

17. A flare burner according to claim 16, wherein a plurality of such gas distributing conduits are connected to said stack conduit and spaced equally around said stack conduit.

18. A flare burner comprising:

a stack conduit for supplying gas;

at least one gas distributing conduit having first and second ends, both of said ends being connected to said stack conduit to permit gas flow into said distributing conduit from both ends; and a plurality of spaced apart supersonic nozzles attached to said at least one gas distributing conduit, each of said supersonic nozzles having a converging section followed by a diverging section;

wherein said gas distributing conduit extends from said stack conduit and forms an upper angled conduit arm and a lower angled conduit arm, said nozzles being attached to said upper angled arm.

19. A flare burner according to claim 18, wherein said upper angled conduit arm extends radially outward and is downwardly sloped and wherein said lower angled arm extends radially outward from said stack conduit and is upwardly sloped.

20. A flare burner according to claim 18, wherein said upper angled conduit arm extends radially outward and is substantially perpendicular to said stack conduit and wherein said lower angled conduit arm extends radially outward and is upwardly sloped.

21. A flare burner according to claim 18, wherein said gas distributing conduit extends radially from said stack conduit.

22. A flare burner according to claim 21, wherein a plurality of such gas distributing conduits are connected to said stack conduit and spaced equally around said stack conduit.

* * * * *